US012408777B2

(12) United States Patent
Murphy

(10) Patent No.: US 12,408,777 B2
(45) Date of Patent: Sep. 9, 2025

(54) EARBUD ACCOMODATING PILLOW DEVICE

(71) Applicant: Angela Murphy, Conroe, TX (US)

(72) Inventor: Angela Murphy, Conroe, TX (US)

( * ) Notice: Subject to any disclaimer, the term of this patent is extended or adjusted under 35 U.S.C. 154(b) by 234 days.

(21) Appl. No.: 18/219,163

(22) Filed: Jul. 7, 2023

(65) Prior Publication Data

US 2024/0000245 A1 Jan. 4, 2024

Related U.S. Application Data

(63) Continuation-in-part of application No. 17/249,117, filed on Feb. 21, 2021, now abandoned.

(51) Int. Cl.
*A47G 9/10* (2006.01)
*A47C 7/38* (2006.01)

(52) U.S. Cl.
CPC ..... *A47G 9/109* (2013.01); *A47C 7/383* (2013.01)

(58) Field of Classification Search
CPC ..... A47C 7/383; A61G 13/121
USPC ..... 5/644, 645, 655.4
See application file for complete search history.

(56) References Cited

U.S. PATENT DOCUMENTS 7,587,773 B2 * 9/2009 Littlehorn ..... A47C 20/025 5/655
8,572,780 B1 11/2013 Watters
9,808,100 B2 11/2017 Jensen
D804,852 S 12/2017 Glaze
10,441,487 B1 10/2019 Jerome-Miller
10,779,664 B2 9/2020 LaHera
2007/0033737 A1 * 2/2007 Melton ..... A47C 7/383 5/640
2007/0056108 A1 * 3/2007 Nikolopoulos ..... A47G 9/1054 5/636
2007/0283495 A1 12/2007 Ghani
2008/0034504 A1 * 2/2008 Schmidt ..... A47G 9/10 5/636
2009/0199341 A1 * 8/2009 Schantz ..... A47G 9/109 5/645
2013/0276236 A1 * 10/2013 Rasmussen ..... A47G 9/1027 5/636
2014/0000036 A1 * 1/2014 Cohen ..... A47C 27/081 5/639
2014/0123394 A1 * 5/2014 Rowland ..... A47C 27/086 5/644
2014/0317851 A1 10/2014 Hammack
(Continued)

FOREIGN PATENT DOCUMENTS

CN 206910167 U * 1/2018
CN 111358246 A * 7/2020
(Continued)

*Primary Examiner* — Eric J Kurilla

(57) ABSTRACT

An earbud accommodating pillow device includes a pillow that is curved between a first end and a second end of the pillow such that the pillow has a U-shape. In this way the pillow can extend around a user's ear when the user lies on the pillow. The pillow is positionable on a sleeping pillow to space the user's ear from the sleeping pillow thereby facilitating the user to wear earbuds while the user is sleeping. The pillow has a first chamber that is filled with a resiliently compressible stuffing to enhance comfort for user's head. The pillow has a pair of second chambers filled with a granular material to conform to the shape of the user's head.

8 Claims, 5 Drawing Sheets

(56) References Cited

U.S. PATENT DOCUMENTS

| | | | | |
|---|---|---|---|---|
| 2017/0280902 | A1* | 10/2017 | Chan | A47C 7/383 |
| 2018/0078063 | A1 | 3/2018 | Wallace | |
| 2020/0288893 | A1* | 9/2020 | Emdadi | A47C 16/00 |
| 2021/0127867 | A1* | 5/2021 | Lee | A47C 7/383 |

FOREIGN PATENT DOCUMENTS

| | | | | |
|---|---|---|---|---|
| CN | 211093161 U | * | 7/2020 | |
| DE | 202014004722 U1 | * | 8/2014 | A47C 7/383 |
| GB | 2528701 A | * | 2/2016 | A47C 7/383 |
| WO | WO2013084005 | | 6/2013 | |

* cited by examiner

EARBUD ACCOMODATING PILLOW DEVICE

CROSS-REFERENCE TO RELATED APPLICATIONS

I hereby claim the benefit under 35 U.S.C., Section 120 of U.S. application Ser. No. 17/249,117 filed Feb. 21, 2021.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to pillow devices and more particularly pertains to a new pillow device for facilitating a user to wear earbuds while sleeping. The device includes a curved pillow that has dimensions sufficient to extend around a user's ear. The curved pillow includes a first chamber filled with a resiliently compressible filling and a pair of second chambers filled with a granular material. The curved pillow is positioned on top of a sleeping pillow to space the user's ear from the sleeping pillow thereby accommodating earbuds in the user's ear.

(2) Description of Related Art Including Information Disclosed Under 37 CFR 1.97 and 1.98

The prior art relates to pillow devices including a variety of pillow devices that each has a unique structure to accommodate a user's ear when the user sleeps on their side including an annular pillow and a curved pillow. In no instance does the prior art disclose a curved pillow that has dimensions to accommodate a user's ear and which has resiliently compressible filling and granular material.

BRIEF SUMMARY OF THE INVENTION

An embodiment of the disclosure meets the needs presented above by generally comprising a pillow that is curved between a first end and a second end of the pillow such that the pillow has a U-shape. In this way the pillow can extend around a user's ear when the user lies on the pillow. The pillow is positionable on a sleeping pillow to space the user's ear from the sleeping pillow thereby facilitating the user to wear earbuds while the user is sleeping. The pillow has a first chamber that is filled with a resiliently compressible stuffing to enhance comfort for user's head. The pillow has a pair of second chambers filled with a granular material to conform to the shape of the user's head.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
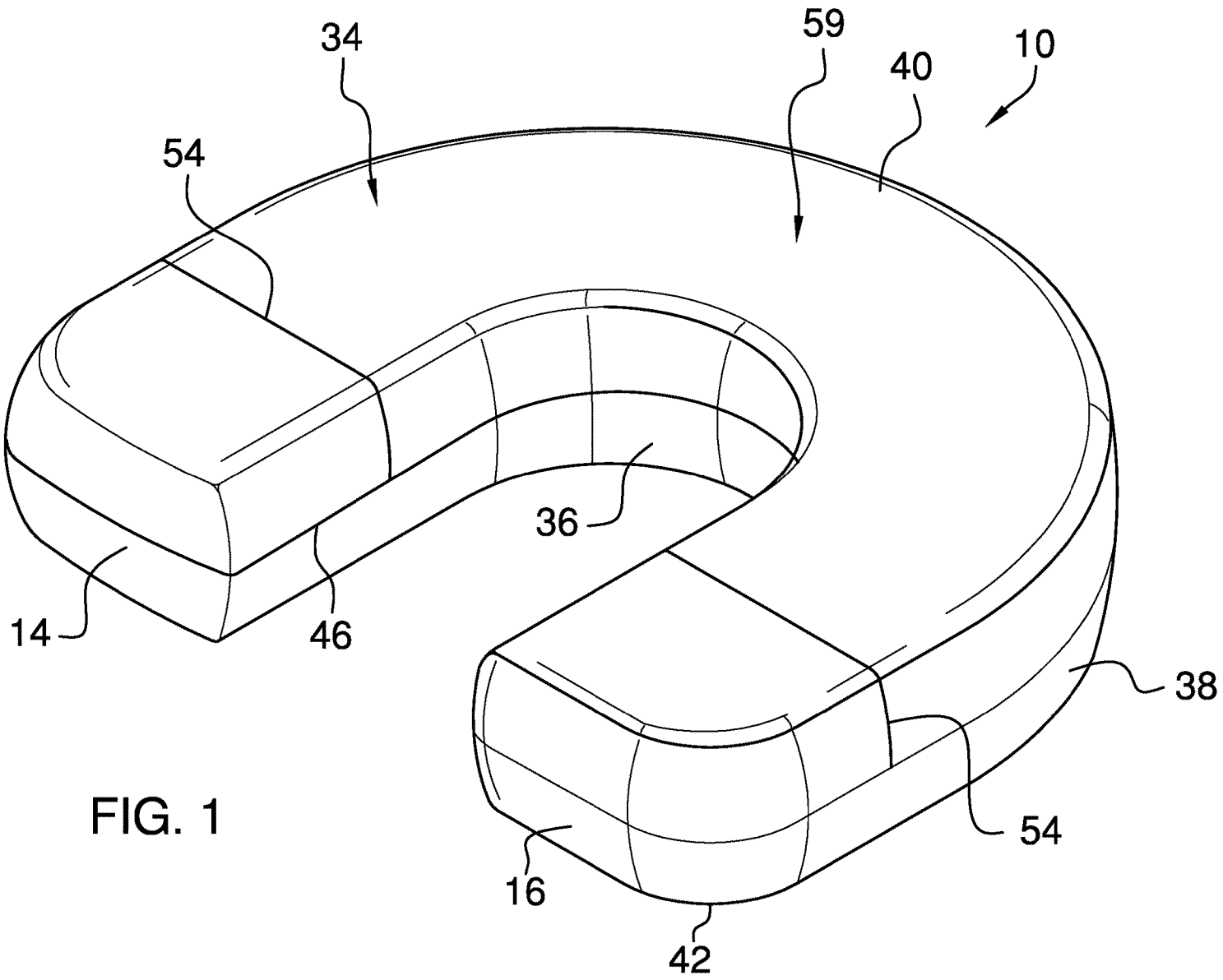
FIG. 1 is a top perspective view of an earbud accommodating pillow device according to an embodiment of the disclosure.
Figure 2:
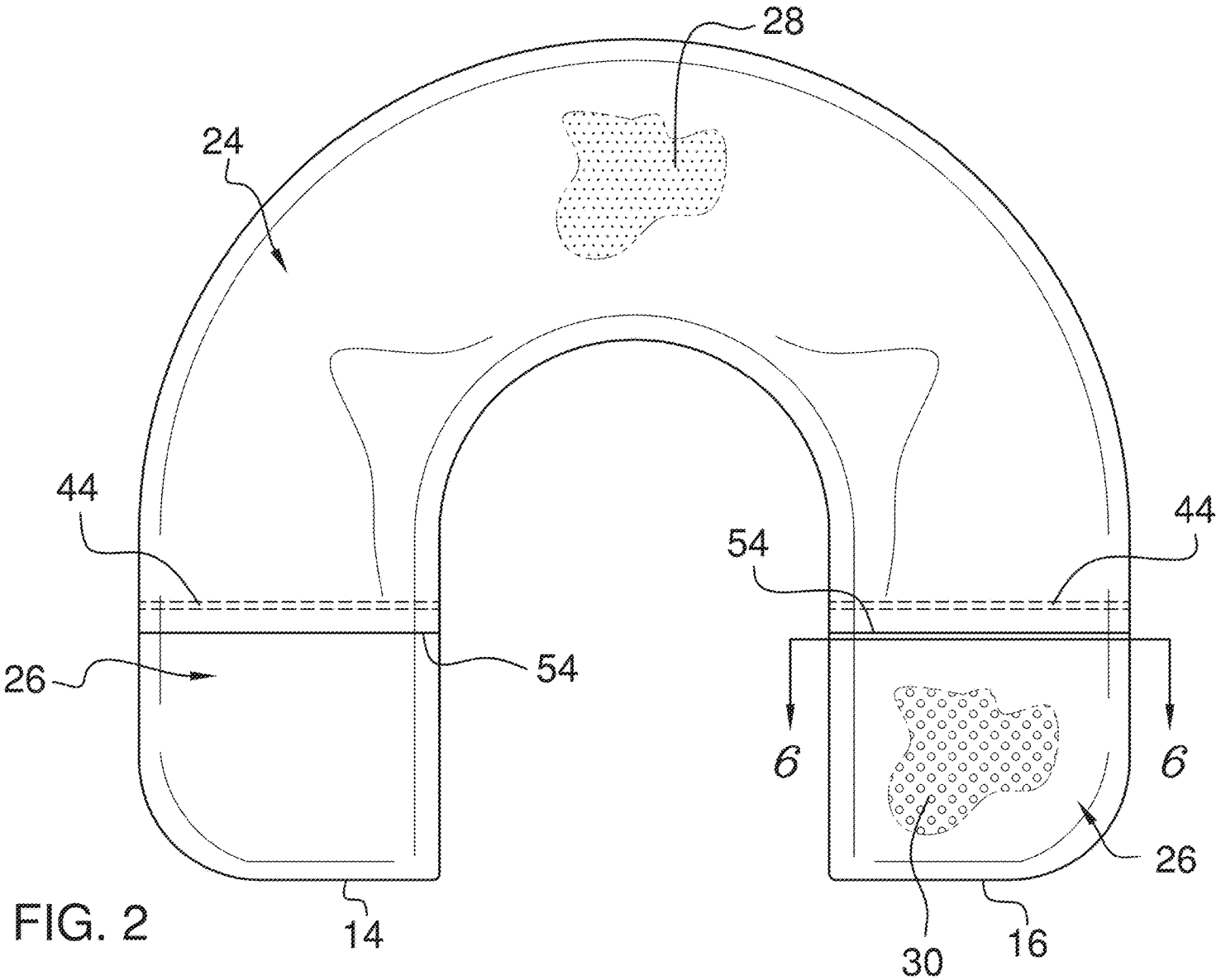
FIG. 2 is a top cut-away view of an embodiment of the disclosure.
Figure 3:
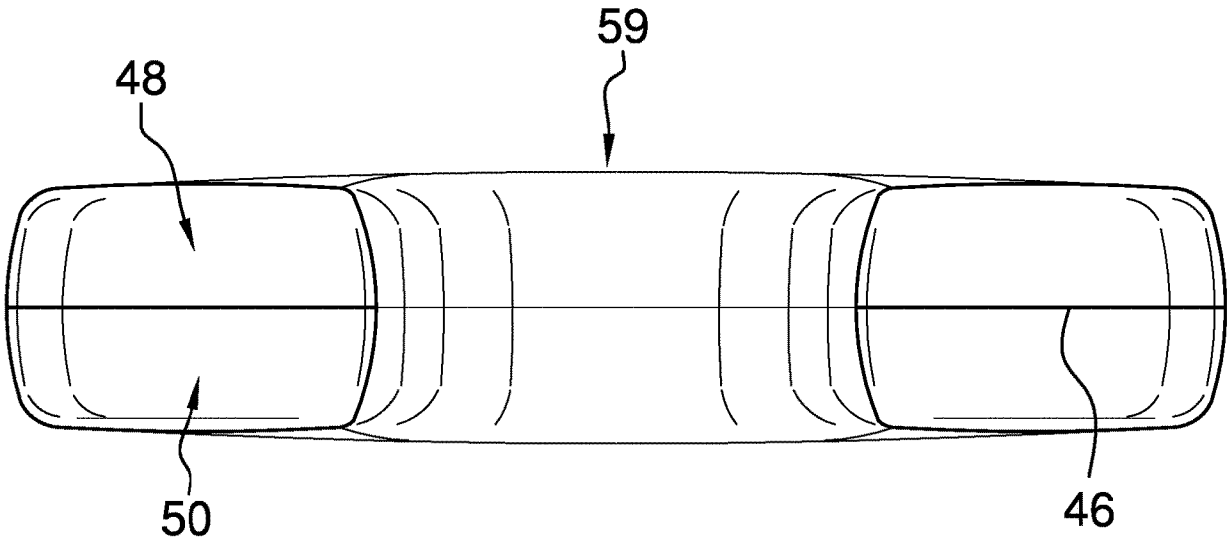
FIG. 3 is a front view of an embodiment of the disclosure.
Figure 4:
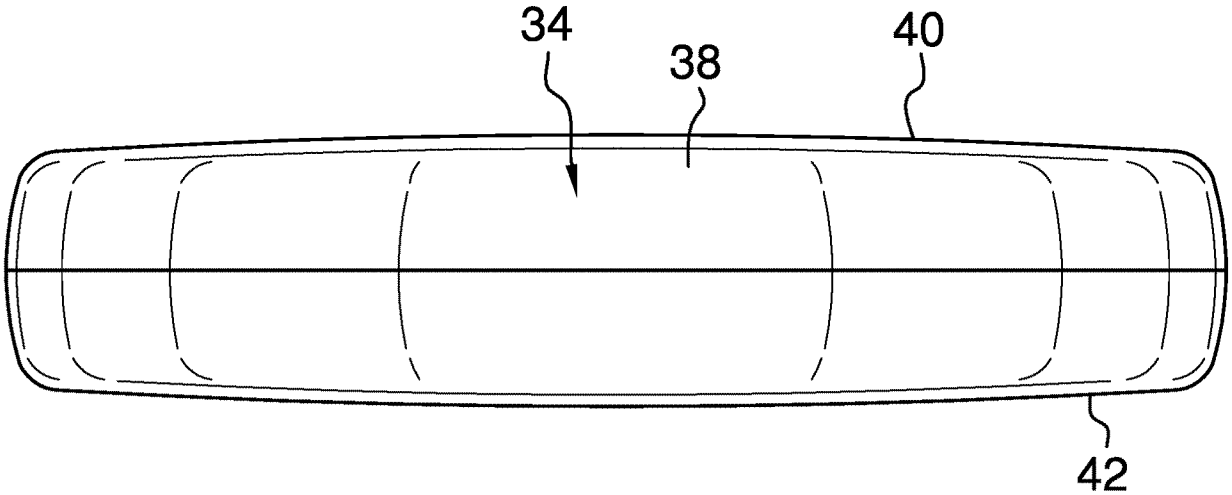
FIG. 4 is a back view of an embodiment of the disclosure.
Figure 5:
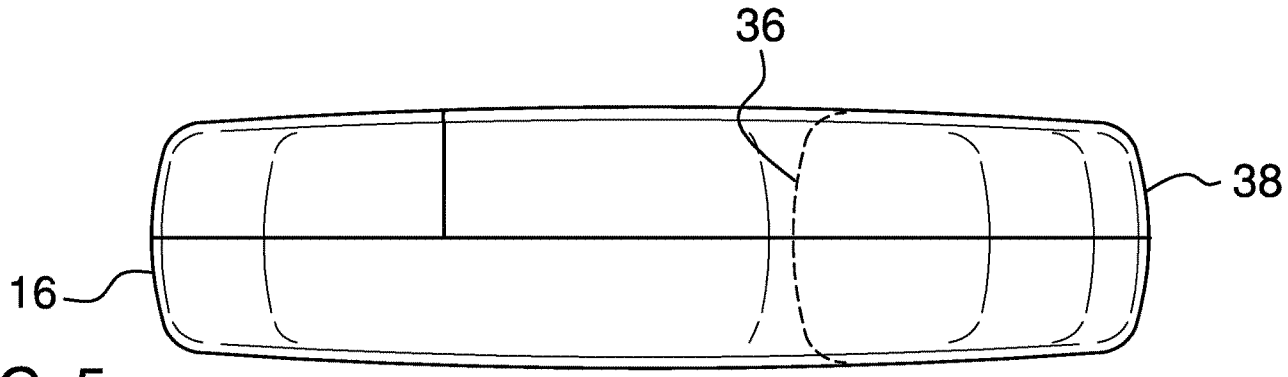
FIG. 5 is a left side view of an embodiment of the disclosure.
Figure 6:
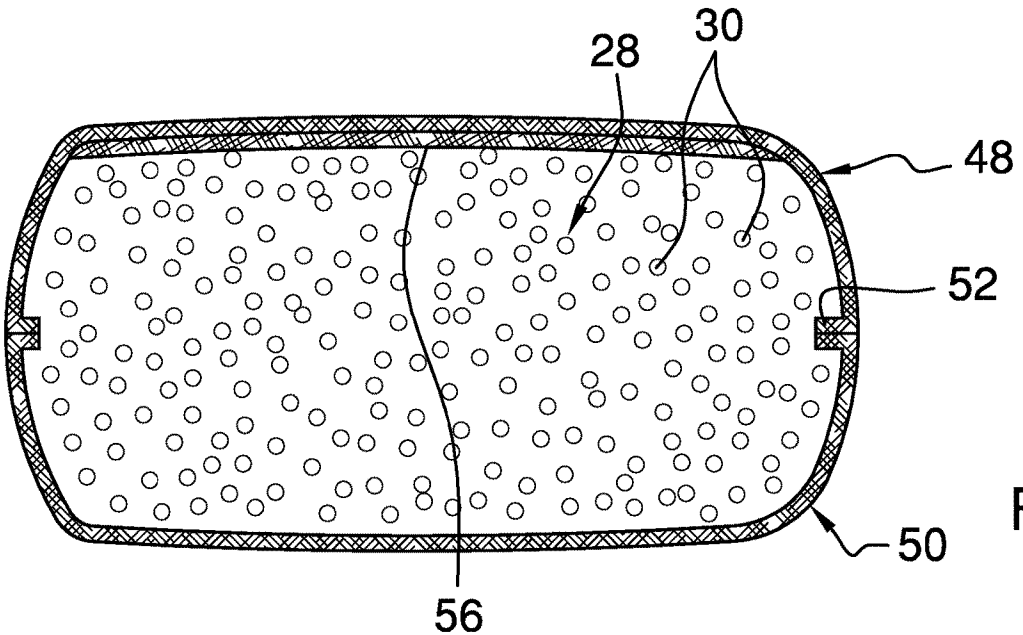
FIG. 6 is a cross sectional view taken along line 6-6 of FIG. 2 of an embodiment of the disclosure.
Figure 7:
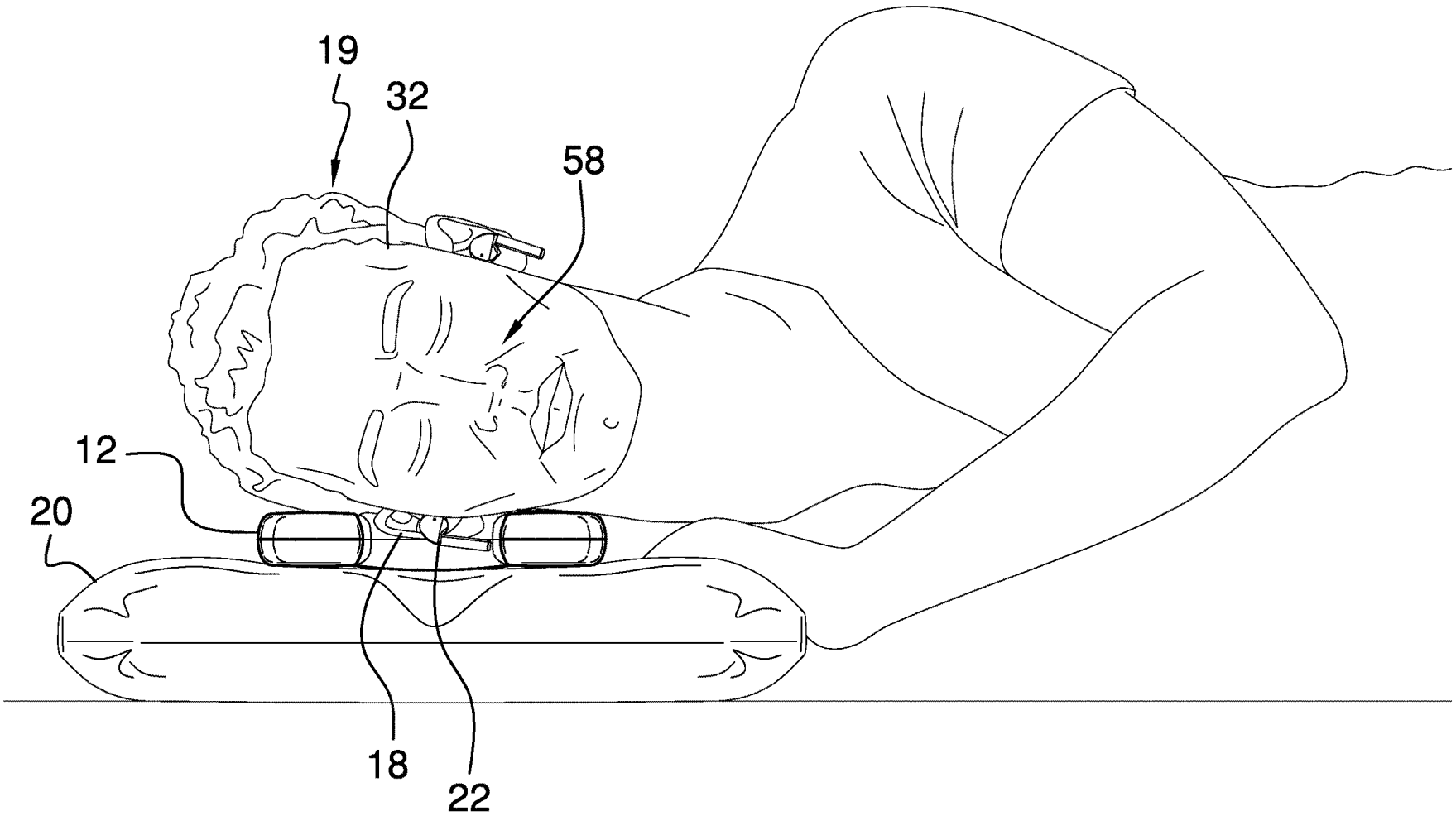
FIG. 7 is a perspective in-use view of an embodiment of the disclosure.

With reference now to the drawings, and in particular to FIGS. 1 through 7 thereof, a new pillow device embodying the principles and concepts of an embodiment of the disclosure and generally designated by the reference numeral 10 will be described.

As best illustrated in FIGS. 1 through 7, the earbud accommodating pillow device 10 generally comprises a pillow 12 that is curved between a first end 14 and a second end 16 of the pillow 12 such that the pillow 12 has a U-shape. Furthermore, the curvature of the pillow 12 has a radius of approximately 5.0 cm thereby facilitating the pillow 12 to extend around an ear 18 of a user 19 when the user 19 lies on the pillow 12. The pillow 12 is positionable on a sleeping pillow 20 to space the user's ear 18 from the sleeping pillow 20. In this way the user 19 can wear earbuds 22 while the user 19 is sleeping without having the earbuds 22 being uncomfortably pressed into the user's ear 18. Thus, the user 19 can listen to therapeutic audible sounds for treating insomnia, for example, while the user 19 is sleeping.

The pillow 12 has a first chamber 24 which extends between a pair of second chambers 26. The first chamber 24 is filled with a resiliently compressible stuffing 28, including but not being limited to cotton or foam rubber, to enhance comfort for user's head 32. Each of the second chambers 26 is filled with a granular material 30, including but not being limited to plastic beads or glass beads. In this way the plurality of second chambers 26 can conform to the shape of the user's head 32.

The pillow 12 has an outer wall 34 extending between the first end 14 and the second end 16 and the outer wall 34 has a front side 36, a back side 38, a top side 40 and a bottom side 42. Each of the first end 14 and the second end 16 intersects the front side 36 at an angle and each of the first end 14 and the second end 16 intersects the back side 38 at a curve. The pillow 12 has a pair of dividers 44 that is each positioned within the pillow 12 and each of the dividers 44 is spaced from a respective one of the first end 14 and the second end 16. In this way the pair of dividers 44 defines the pair of second chambers 26 between the dividers 44 and a respective one of the first end 14 and the second end 16. Furthermore, the pair of dividers 44 defines the first chamber 24 extending between the pair of dividers 44. Each of the second chambers 26 is fluidly discrete with the first chamber 24 thereby inhibiting the granular material 30 from entering the first chamber 24.

The pillow 12 has a first cut 46 extending through the outer wall 34 and the first cut 46 extends along each of the front side 36 and the back side 38 of the outer wall 34 and along each of the first end 14 and the second end 16. In this way the first cut 46 defines a top half 48 of the pillow 12 and a bottom half 50 of the pillow 12. Each of the top half 48 and the bottom half 50 is stitched together along the first cut 46 to define a first seam 52 that is directed into an interior of the pillow 12. The pillow 12 has a pair of second cuts 54 each extending through the top half 48 of the pillow 12. Each of the second cuts 54 extends laterally across the top half 48 such that each of the second cuts 54 extends along a line that is oriented parallel to a respective one of the first end 14 and the second end 16. Additionally, the top half 48 is sewn together at each of the pair of second cuts 54 to define a pair of second seams 56 that is each directed into the interior of the pillow 12.

The pillow 12 may have a thickness between the front side 36 and the back side 38 of the outer wall 34 of approximately 7.5 cm at the curve 59 in the pillow 12 and the pillow 12 may have an outside width of approximately 23.0 cm between the first end 14 and the second end 16. Furthermore, the pillow may have a length of approximately 10.0 cm between the curve 59 and each of the first end 14 and the second end 16 of the pillow 12. The pillow 12 may have a height to approximately 5.0 cm between the top side 40 and the bottom side 42 of the outer wall 34 of the pillow 12 at the curve 59. Additionally, the pillow 12 may have a height of approximately 2.0 cm between the top side 40 and the bottom side 42 of the outer wall 34 of the pillow 12 at each of the first 14 end and the second end 13.

In use, the pillow 12 is placed on top of a sleeping pillow 20 and the user 19 lies on the pillow 12 such that the pillow 12 surrounds the user's ear 18 having each of the first end 14 and the second end 16 of the pillow 12 being directed toward the user's face 58. In this way the user's ear 18 is spaced from the sleeping pillow 20 when the user 19 is sleeping on their side. Thus, the user 19 can wear earbuds 22 without having the earbuds 22 being uncomfortably pressed into the user's ear 18. In this way the user 19 can listen to audible sounds through the earbuds 22 to treat insomnia, for example, while the user 19 is attempting to sleep. Furthermore, each of the second chambers 26 is positioned on the side of the user 19's face and the first chamber 24 curves behind the user's ear 18. In this way the granular beads conform to the shape of the side of the user's face 58 while the resiliently compressible stuffing 28 cushions the user's head 32 thereby enhancing comfort and support for the user 19.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An earbud accommodating pillow system comprising:

a sleeping pillow being configured to be positioned between a user's head and a bed upon which the user is sleeping;

a support pillow being curved between a first end and a second end of said support pillow such that said support pillow has a U-shape wherein said support pillow is configured to extend around a user's ear when the user lies on said support pillow, said support pillow being positionable on the sleeping pillow wherein said support pillow spaces the user's ear from the sleeping pillow thereby facilitating the user to wear earbuds while the user is sleeping, said support pillow having a first chamber extending between a pair of second chambers, said first chamber being filled with a resiliently compressible stuffing wherein said first chamber is configured to enhance comfort for user's head, each of said second chambers being filled with a granular material wherein each of said plurality of second chambers is configured to conform to the shape of the user's head.

2. The system according to claim 1, wherein:

said support pillow has an outer wall extending between said first end and said second end, said outer wall having a front side, a back side, a top side and a bottom side;

each of said first end and said second end intersects said front side at an angle;

each of said first end and said second end intersects said back side at a curve; and said support pillow having a pair of dividers each being positioned within said support pillow, each of said dividers being spaced from a respective one of said first end and said second end.

3. The system according to claim 2, wherein said pair of dividers defines said pair of second chambers between said dividers and a respective one of said first end and said second end.

4. The system according to claim 2, wherein said pair of dividers defines said first chamber extending between said pair of dividers.

5. The system according to claim 1, wherein each of said second chambers is fluidly discrete with said first chamber thereby inhibiting said granular material from entering said first chamber.

6. The system according to claim 2, wherein said support pillow has a first cut extending through said outer wall, said first cut extending along each of said front side and said back side of said outer wall and along each of said first end and said second end to define a top half of said support pillow and a bottom half of said support pillow, each of said top half and said bottom half being stitched together along said first cut to define a first seam being directed into an interior of said support pillow.

7. The system according to claim 6, wherein said support pillow has a pair of second cuts each extending through said top half of said pillow, each of said second cuts extending laterally across said top half such that each of said second cuts extends along a line being oriented parallel to a respective one of said first end and said second end, said top half being sewn together at each of said pair of second cuts to define a pair of second seams each being directed into said interior of said support pillow.

8. An earbud accommodating pillow system for facilitating a user to sleep on their side while wearing earbuds, said system comprising:

a sleeping pillow being configured to be positioned between a user's head and a bed upon which the user is sleeping;

a support pillow being curved between a first end and a second end of said support pillow such that said support pillow has a U-shape wherein said support pillow is configured to extend around a user's ear, said support pillow being positionable on top of said sleeping pillow wherein said support pillow is configured to space the user's ear from said sleeping pillow thereby facilitating the user to wear ear buds while the user is sleeping, said support pillow having a first chamber extending between a pair of second chambers, said first chamber being filled with a resiliently compressible stuffing wherein said first chamber is configured to enhance comfort for user's head, each of said second chambers being filled with a granular material wherein each of said plurality of second chambers is configured to conform to the shape of the user's head, said support pillow having an outer wall extending between said first end and said second end, said outer wall having a front side, a back side, a top side and a bottom side, each of said first end and said second end intersecting said front side at an angle, each of said first end and said second end intersecting said back side at a curve, said support pillow having a pair of dividers each being positioned within said support pillow, each of said dividers being spaced from a respective one of said first end and said second end, said pair of dividers defining said pair of second chambers between said dividers and a respective one of said first end and said second end, said pair of dividers defining said first chamber extending between said pair of dividers, each of said second chambers being fluidly discrete with said first chamber thereby inhibiting said granular material from entering said first chamber, said support pillow having a first cut extending through said outer wall, said first cut extending along each of said front side and said back side of said outer wall and along each of said first end and said second end to define a top half of said support pillow and a bottom half of said support pillow, each of said top half and said bottom half being stitched together along said first cut to define a seam being directed into an interior of said support pillow, said support pillow having a pair of second cuts each extending through said top half of said support pillow, each of said second cuts extending laterally across said top half such that each of said second cuts extends along a line being oriented parallel to a respective one of said first end and said second end, said top half being sewn together at each of said pair of second cuts to define a pair of second seams each being directed into said interior of said support pillow.

* * * * *